US007221861B1

(12) United States Patent
Hannigan et al.

(10) Patent No.: US 7,221,861 B1
(45) Date of Patent: May 22, 2007

(54) UNIVERSAL TRANSFER APPARATUS AND METHOD TO USE SAME

(75) Inventors: Robyn Hannigan, Jonesboro, AR (US); David Clarke, Jonesboro, AR (US)

(73) Assignee: Arkasas State University - Research and Development Institute (ASU-RDI), State University, AR (US)

( * ) Notice: Subject to any disclaimer, the term of this patent is extended or adjusted under 35 U.S.C. 154(b) by 0 days.

(21) Appl. No.: 11/272,191

(22) Filed: Nov. 10, 2005

(51) Int. Cl.
*F24H 1/10* (2006.01)

(52) U.S. Cl. ..... 392/478; 95/89

(58) Field of Classification Search ..... None
See application file for complete search history.

(56) References Cited

U.S. PATENT DOCUMENTS

| | | | | |
|---|---|---|---|---|
| 4,440,550 | A * | 4/1984 | Jenkins et al. | 95/89 |
| 2002/0019058 | A1 | 2/2002 | Godec et al. | |
| 2003/0138970 | A1 | 7/2003 | Godec et al. | |
| 2004/0126276 | A1 | 7/2004 | Ilgen et al. | |

OTHER PUBLICATIONS

Bouyssiere, Brice, et al. Gas chromatography with inductively coupled plasma mass spectrometric detection in speciation analysis, Spectrochemica Acta Part B, 2002, 805-828, vol. 57, Elsevier Science B.V.

Chong, N.S., et al. Inductively Coupled Plasma-Mass Spectrometry For Elemental Analysis and Isotope Ratio Determinations in Individual Organic Compounds Separated by Gas Chromatography, Applied Spectroscopy, 1987, 66-74, vol. 41, Society for Applied Spectroscopy.

Clarke, D. and Hannigan, R., Analysis of riverine metal-organic complexes by gas chromatography-inductively coupled plasma mass spectrometry. Geol. Soc. Am. Ann. Meeting, Nov. 7-10, 2004, Denver, Colorado. [presentation].

Elobeid, M., et al., Chemical Analysis Of Tabacco Smoke using GC-NCD, GC-SCD, GC-FID and GC-ICP-MS, Apr. 2-3, 2004, Arkansas Academy of Science Annual Meeting, Jonesboro, Arkansas. [presentation].

Elobeid, M, et al. Speciation of Metals in Tobacco Smoke Using Gas Chromatography interfaced to an Inductively Coupled Plasma-Mass Spectometry, Feb. 17-22, 2004, Annual meeting of the Society for Research on Nicotine and Tobacco, Scottsdale, Arizona. [presenation].

Elobeid, et al., Speciation analysis with GC-ICP-MS: Orgamoetal detection in tobacco smoke. Sep. 13-17, 2004, The 9th International Conference on Plasma Source Mass Spectrometry, Durham, Colorado. [presentation].

Hannigan, R.E. The Chemistry of Tobacco Smoke, Center for Addiction Studies, University of Arkansas-Pine 'Bluff, Oct. 14, 2004, Pine Bluff, Arkansas, USA. [presentation].

(Continued)

*Primary Examiner*—Thor S. Campbell
(74) *Attorney, Agent, or Firm*—Butler, Snow, O'Mara, Stevens & Cannada, PLLC

(57) ABSTRACT

The present invention provides universal transfer apparatus and method to use this universal transfer apparatus. This invention further provides a method to obtain speciation data for organometals in a complex matrix, such as cigarette smoke. Our data demonstrate that gas chromatography linked to inductively coupled plasma mass spectrophotometer with the universal transfer apparatus provides metal speciation information for samples of tobacco smoke. The organometals include lead, tin, arsenic and cadmium.

5 Claims, 8 Drawing Sheets

OTHER PUBLICATIONS

Hirner, A., et al. Volatile Metal and Metalloid Species in Gases from Municipal Waste Deposits, Applied Organometrallic Chemistry, 1994, 65-69, vol. 8, John Wiley & Sons, Ltd.

Kalcher, K., et al. Cadmium and lead in the smoke of a filter cigarette. The Science of the Total Environment, 1993, 21-35, vol. 128, Elsevier Science Publishers B.V.

Krivan, V., Multi-element characterization of tobacco smoke condensate, Fresenius' Journal of Analytical Chemistry, 1994, 218-225, vol. 348, Springer-Verlag.

Leal-Granadillo, Ivan, et al. Determination of the speciation of organolead compounds in airbourne particulate matter by gas chromatography—inductively coupled plasma mass spectrometry, Analyitica Chimica Acta, 2000, 21-49, vol. 423, Elseveir Science B.V.

Milnerowicz, H., et al. Effects of Exposure to Tobacco Smoke in Pregnancies Complicated by Oligohydramnios and Premature Rupture of the Membranes. I. Concentration of Cd AND Pb in Blood and Zn, Cu, Cd and Pb in Amniotic Fluid, 2001, 185-193, vol. 13, Poland.

Peeler, C., Cigarette Testing and the Federal Trade Commission: A Historical Overview, Smoking and Tobacco Control Monograph No. 7, Chapter 1, 1-14, The FTC Cigarette Test Method for Determining Tar, Nicotine, and Carbon Monoxide Yields of US Cigarettes, Report of the NCI Expert Committee, US Department of Health and Human Services.

Pillsbury, H., Review of the Federal Trade Commission Method for Determining Cigarette Tar and Nicotine Yield, Chapter 2, 9-14, The FTC Cigarette Test Method for Determining Tar, Nicotine, and Carbon Monoxide Yields of US Cigarettes, Report of the NCI Expert Committee, US Department of Health and Human Services.

Rapsomanikis, S., Derivatization by Ethylation With Sodium Tetraethylborate for the Speciation of Metals and Organometallics in Environmental Samples, A Review, The Analyst, Jul. 1994, 1429-1439, vol. 119, The Royal Society of Chemistry.

Schubert, H., et al. Performance and application potential of ion-molecule reaction mass spectrometry (IMR-MS) in the analysis of complex gas mixtures, Fresenius Journal of Analytical Chemistry, 1996, 127-137, vol. 356, Springer-Verglag.

de Smaele, et al. A flexible interface for the coupling of capillary gas chromatography with inductively coupled plasma mass spectrometry, Spectrochimica Acta Part B, 1995, 1409-1416, vol. 50, Elsevier Science, B.V.

Torjussen, William, et al. Cigarette smoking and nickel exposure, Journal of Environ. Mont., 2003, 198-201, vol. 5, The Royal Society of Chemistry.

Tseng, C. M., et al. Field cryofocussing hydride generation applied to the simultaneous, multi-elemental determination of alkyl-metal-(loid) species in natural wafers using ICP-MS detection. Journal of Environ. Monit., 2000, 603-612, vol. 2, The Royal Society of Chemistry.

Van Loon, Inductively Coupled, Plasma Source Mass Spectrometry—A New Element-Isotope Specific Mass Spectrometry Detector for Chromatography, Spectroscopy Letters, 1986, 1125-1135, vol. 19(10), Marcel Dekker, Inc.

* cited by examiner

UNIVERSAL TRANSFER APPARATUS AND METHOD TO USE SAME

STATEMENT REGARDING FEDERALLY SPONSORED RESEARCH OR DEVELOPMENT

NONE

FIELD OF INVENTION

The present invention relates to a universal transfer apparatus and method to use this transfer apparatus to obtain data on analytes, such as speciation data for organometals, using a detector apparatus, such as an inductively coupled plasma mass spectrometer.

BACKGROUND OF THE INVENTION

Toxic metals in tobacco smoke present a significant health risk. (H. Milnerowicz et al., 13 Int. J. Occup. Med. Environ. Health 185 (2000)). Metals such as lead, cadmium, arsenic, and tin have a relatively high transfer rate from tobacco into smoke. (V. Krivan, et al., 348 Fresenius J. Anal. Chem. 218 (1994)). These metals are known to be carcinogens, nephrotoxins, hepatotoxins and neurotoxins and can persist in the body for long periods of time. The total concentrations of metals in cigarette and tobacco smoke have been well established. (K. Kalcker, et al., 21 Sci. Total Environ. 128 (1993); W. Torjussen, et al., 5 J. Environ. Monit. 198 (2003)). However, it has been recognized that the total metal concentration is not sufficient to evaluate the impact of these metals on the environment and on human health. (S. Rapsomanikis, 119 Analyst (1994)). It is the specific physiochemical form of the metal that governs its toxicity, bioavailability, and its potential for bioconversion and bioaccumulation. In the case of tobacco smoke the relative abundances of metals species, particularly organometals species, are unknown. By establishing the chemical species of metals in tobacco smoke, the risks associated with inhalation of these compounds can be evaluated. This requires the development of an analytical technique for speciation of metals in the tobacco smoke.

Speciation methods are usually based on hyphenated techniques combining a chromatographic separation method with an element specific detection system, such as atomic absorption spectrometry (AAS), atomic emission spectroscopy (AES) or inductively coupled plasma-mass spectrometer (inductively coupled plasma mass spectrophotometer). Among the various speciation methods, gas chromatography with inductively coupled plasma-mass spectrometer (inductively coupled plasma mass spectrophotometer) has been increasingly applied as a means of speciation analysis for organometals in different environmental samples. (T. De Smaele, et al., 50 Spetrochimica Acta Part B 1409 (1995)). Chromatographic separation is ideally suited to complicated sample matrices and low analyte abundances; it separates compounds in complex mixtures based on their molecular size, boiling point and polarity. State-of-the-art dynamic reaction cell (DRC) inductively coupled plasma mass spectrophotometer provides superior sensitivities for metals and the capacity for simultaneous multi-element determination.

Coupling of a gas chromatograph to an inductively coupled plasma mass spectrophotometer originated with Van Loon et al., 41 Appl. Spectros. 66 (1987); J. Van Loon, et al., 19 Spectrosc. Letters 1125 (1986)), but little was reported on the application of this instrument configuration during the subsequent five years. (B. Bouyssiere, infra, at 805). Since 1992, based on the need for a reliable method of speciating metals in environmental samples, more and more applications of gas chromatography-inductively coupled plasma mass spectrophotometer have been reported. The gas chromatography inductively coupled plasma mass spectrophotometer technique has been applied to speciation studies in atmospheric samples (A. V. Hirner et al., 8 Appl. Organometallic Chem. 65 (1994)) in natural waters (C. M. Tseng, et al., 2 J. Environ. Monit. 603 (2003)) and in solids, including atmospheric particulate matter. (I. A. Leal-Granadillo, et al., 21 Anal. Chim. Acta 423 (2000)). Despite the multi-element capabilities of the inductively coupled plasma mass spectrophotometer, all analytes have to be separable by the gas chromatography in order to be detected by the inductively coupled plasma mass spectrophotometer. The gas chromatography requires volatile species. However, those organometal compounds with boiling points higher than the maximum gas chromatography column temperature cannot be adequately separated and so cannot be studied using direct sample injection and gas chromatography inductively coupled plasma mass spectrophotometer analysis.

BRIEF SUMMARY OF THE INVENTION

The present invention provides a universal transfer apparatus that is independent of the gas phase sample source and the detection system. The present transfer line is not integrated with an ICP torch, has an independent heat control for the transfer line and the make-up gas pre-heater does not require that the gas phase sample be delivered by a gas chromatograph, but can include other sources, such as, gravimetric analysis, direct atmospheric sampling or headspace sampling.

More specifically, the present invention provides a transfer apparatus for transmitting a gas phase sample containing an analyte to be measured from a sample source to a detection system. The universal transfer apparatus is made up of the transfer line directly or indirectly connected to the sample source. Additionally, the transfer line includes a means to transmit the gas phase sample to a pre-heater. The pre-heater is configured to heat the gas phase sample to a temperature required for the detection of an analyte by a detector system. This transfer apparatus allows for the delivery of gas phase samples without reduction of the boiling point of the complex sample. Specifically, the gas sample is heated to a temperature compatible with the temperature of the detection system. In the case of inductively coupled plasma spectrophotometric detection the gas phase sample is heated, within the make-up gas pre-heater, to a maximum temperature of 250° C. to prevent sample condensation during delivery of sample to detection system.

In a specific embodiment, a gas chromatograph apparatus is coupled to an inductively coupled plasma mass spectrophotometer by the universal transfer apparatus. This combination offers a highly sensitive and selective method for the determination of organometal compounds in complex matrices, such as smoke. The exceptional chromatographic separation capability of the gas chromatograph coupled to the sensitivity, selectivity, and multi-elemental capability of the inductively coupled plasma mass spectrophotometer detector makes this combination a tool for environmental and medical analysis.

More specifically, this invention provides a method to obtain organometal speciation data of cigarette smoke. The steps of this method include providing a gas chromatograph and inductively coupled plasma mass spectrophotometer apparatus coupled together using the universal transfer apparatus, providing an apparatus to produce cigarette smoke; collecting the cigarette smoke, extracting at least one organometal from the cigarette smoke, derivatizing the at least one organometal and injecting the at least one organometal into the gas chromatograph transferring the at least one organometal via the transfer line apparatus to the detector, and analyzing the at least one organometal to obtain data. The speciation data includes the concentration of individual organometals including tin, lead, arsenic and cadmium.

DETAILED DESCRIPTION OF THE INVENTION

1. Definitions

The following terms and acronyms are used throughout the detailed description.

Chemical species are specific forms of an element defined as to isotope composition, electronic or oxidation state, and/or complex or molecular structure.

Complex matrix is a sample containing a combination of elements.

Derivitization is the conversion of ionic of polar species to their fully alkylated forms, which normally are more volatile and have lower boiling points and are thus within the operational range of a gas chromatographic instrument.

Make up gas is an additional gas that must be constantly flowed into the detector. This gas makes up the additional needed gas flow and so is termed make up gas.

Organometal or organometallic refers to compound in which metal ions are directly bonded to organic carbon containing species.

Speciation are the methods for and results of establishing the physiochemical from of metal(loid)s—including oxidation states, coordination numbers, ligands and individual concentrations.

2. Overview of the Apparatus and Method

Figure 1:
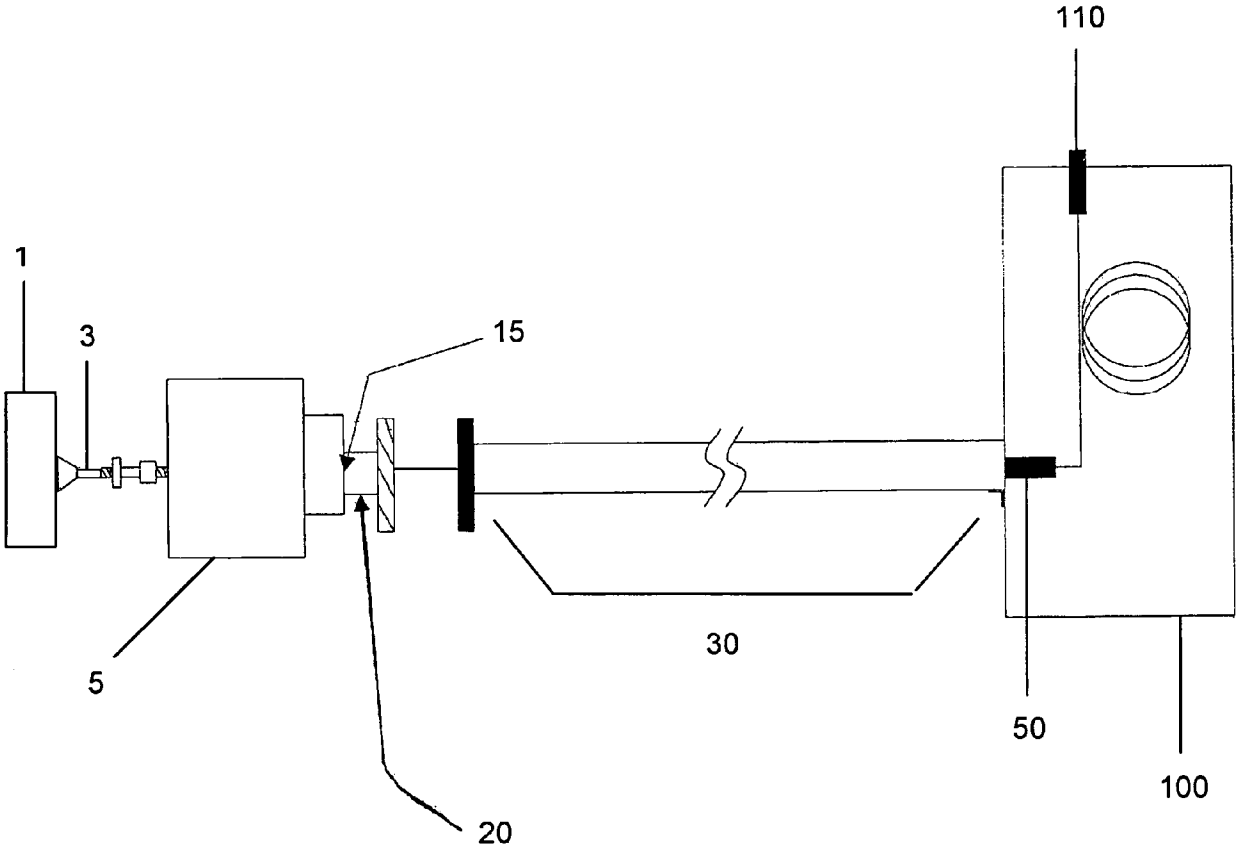
FIG. 1 shows a schematic diagram of an interface between a gas chromatograph and inductively coupled plasma mass spectrophotometer.

FIG. 1 shows a schematic diagram of an interface between a gas chromatograph and inductively coupled plasma mass spectrophotometer. A detector system 1, such as ICP spectrophotometer is attached by a connector 3 to a pre-heater 5. The connector 3 is configured depending on the type of detector 1. The preheater 5 is attached via septum 15 to an adaptor 20. The adaptor 20 is configured to connect to a transfer line 30. In one embodiment, that adaptor 20 is a threaded screw cap. The transfer line 30 is connected to a gas chromatograph 100. In one embodiment, the transfer line 30 is connected by a vice screw connector.

Figure 2:
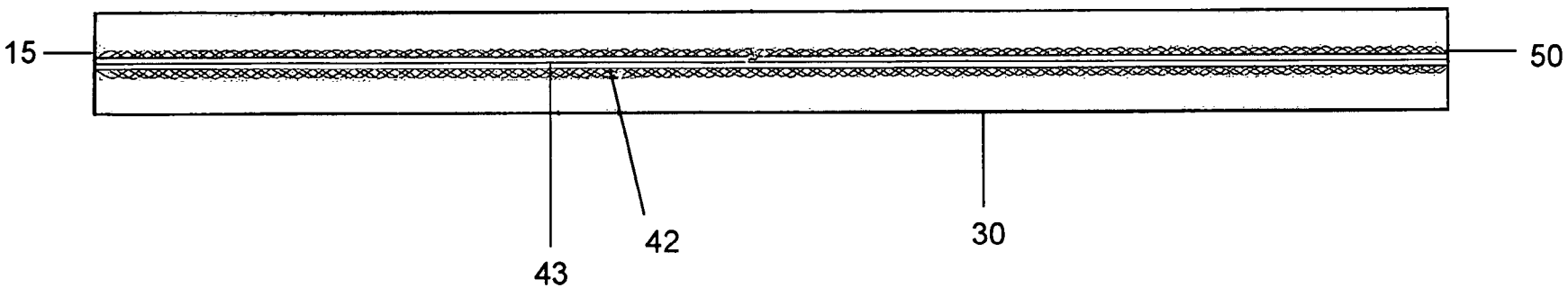
FIG. 2 shows a schematic diagram of a transfer line between a gas chromatograph and a plasma mass spectrophotometer.

More specifically, as shown in FIG. 2, the transfer line 30 is connected to the preheater 5 via a septum 15. The transfer line 30 includes an embedded thermocouple in nichrome wire/PFTE tubing 42 connected to the septum 15 on one end of the transfer line and a capillary tube 50 from the sample source 100 such as a gas chromatograph on the other end of the transfer line 30. The capillary tube 50 goes through the septum 15 and the sample is swept along the transfer line 30 by the flow of carrier gas. The tubing 42 is covered with an insulation, such as fiberglass, to maintain the desired temperature. The tubing 42 surrounds a nichrome wire 43. The transfer line 30 in one embodiment is heated to a temperature compatible to the temperature of the sample source 100 effulent of the chromatography column 110.

Figure 3B:
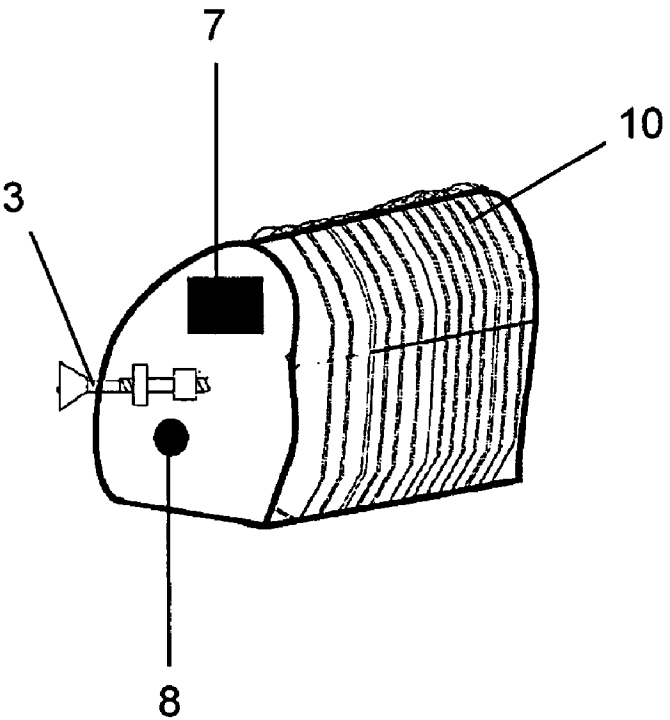
FIG. 3B shows a schematic diagram of a preheater.
Figure 3A:
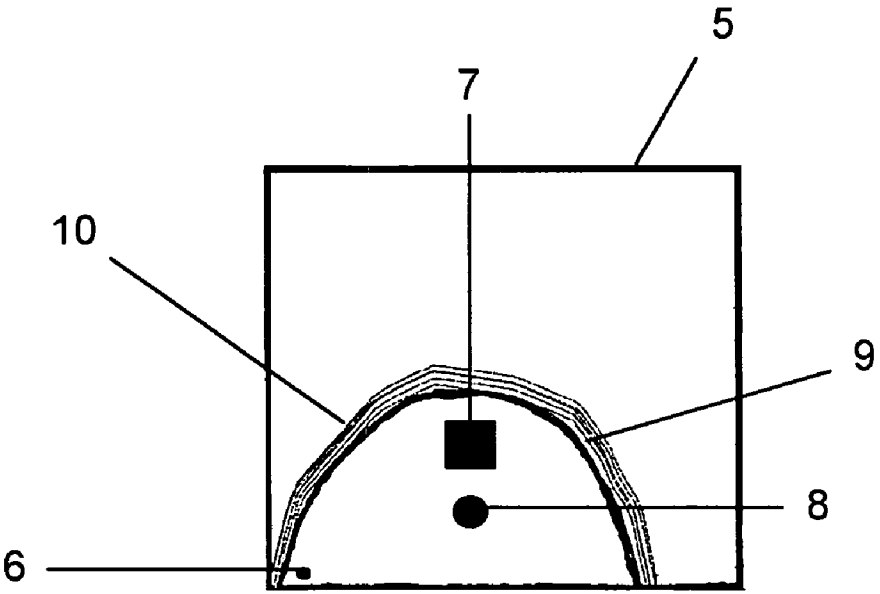
FIG. 3A shows a schematic diagram of a preheater.

Now referring to FIGS. 3A and 3B, a high flow rate of make up gas is applied at the end of the transfer line 30 and heated before the gas stream enters the sampling introduction system of the detector system 1. The preheat 5 include a control box 6 to control the temperature. Gas sample enters the gas pre-heater 5 in the rear of the pre-heater Aluminum block 9. The sample capillary 50 is here enclosed in ⅛" internal diameter steel tubing 10 which contains make-up gas such as Argon or Helium, etc. The steel tubing 10 containing the sample capillary 50 is wound around a steel block which is heated to an operator defined temperature using a cartridge heater 7. Make-up gas enters the steel tubing 10 at point 8. The heated gas sample exits the pre-heater 5 and enters the detection system 1 at the front of the pre-heater 5. A thermocouple, inserted in the Aluminum block 9 of the of the pre-heater 5 monitors make-up gas temperature, ensuring no sample condensation prior to exit of sample to detector 1.

In operation, a gas phase sample is introduced to the transfer line 30 via a capillary tube 50. In the case of gas chromatographic system, the capillary tube 50 is a capillary column (e.g. fused silica). The gas phase sample is introduced either directly or indirectly without separation via thermal gravimetric analysis, by head space sampling, or by direct atmospheric sampling. The transfer line 30 transmits the gas phase sample to a preheater 5. The gas phase sample is heated to the desired temperature dependent on sample analyte. Temperature is heated gradually to a max of 250° C. to separate analytes and maintain gas phase. In one embodiment, heated make-up gas (e.g. Ar, He, Xe or any combination thereof for plasma ionization detection) can be added. The make-up gas can be kept separate or can be mixed with the gas phase sample for chemical ionization prior to detection. The heated gas phase sample can then enter the detector system 1, such as an inductively coupled plasma mass spectrometer (ICP-MS), microwave induced plasma mass spectrometer, or electrospray mass spectrometer, or direct detector injection for flame ionization, chemiluminescence, fluorescence, electrochemical, or spectrophotometric detection (e.g., infrared, ultra-violet-visible).

The present invention relates to the use of the gas chromatography inductively coupled plasma mass spectrophotometer apparatus to speciate metal compounds in mainstream and sidestream tobacco smoke, with focus on organolead and organotin complexes. Gas chromatography provides a means to chemically separate organic molecules in the gas phase. Mass spectrophometer provides a means to identify total metal information. If a gas chromatograph is coupled to a mass spectrophotometer, then the quantity of the metal composition of the organic molecules can be determined. Our data demonstrate that gas chromatography inductively coupled plasma mass spectrophotometer provides metal speciation information for a complex sample, such as tobacco smoke or surface water.

To assess metal speciation in tobacco smoke, a gas chromatograph was linked to inductively coupled plasma mass spectrophotometer. A Clarus 500 GC and a DRC II inductively coupled plasma mass spectrophotometer were coupled with a transfer line (apparatus as shown in FIGS. 1–3). The transfer line 30 is heated to a temperature comparable to the temperature of gas chromatograph effluent. High flow rate (1.0 L/min) of ultra pure argon gas was applied and heated at the end of the transfer line 30 from the nebulizer outlet of the inductively coupled plasma mass spectrophotometer, just prior to the gas stream entering the sampling introduction system (torch) of the inductively coupled plasma mass spectrophotometer. The gas chromatography and inductively coupled plasma mass spectrophotometer operation conditions are shown in Table 1.

TABLE 1

| Clarus 500 Gas Chromatograph (Perkin Elmer Sciex, Norwalk, Connecticut) | |
|---|---|
| Injection technique | Splitless/split (50:1) |
| Injection volume | 1μ/2μ |
| Inlet temperature | 230° C. |
| Column | Supelco (30 m × 0.25 mm × 1.5 m film thickness) |
| Carrier gas flow | 9.5 psi (0.72 ml/min) |
| Carrier gas | He (ultra pure) |
| Oven temperature | Initial temp: 120° C., initial time: 1 min, rate: 20° C./min, final temp: 250° C., final time: 12.5 min |

| Elan ® DRC-II Inductively Coupled Plasma Mass Spectrophotometer (Perkin Elmer Sciex, Norwalk, Connecticut) | |
|---|---|
| Parameter/System | Setting/Type |
| Injector | 2.0 mm i.d. Quartz (N8125029) |
| Sampling Cone | Nickel (WE021140) |
| Skimmer Cone | Nickel (WE021137) |
| RF Power | 1100 W |
| Plasma Air Flow | 15 L/min |
| Nebulizer Air Flow | 1.0 L/min |
| Reaction Gas | Ammonia (99.999%, NexAir, Memphis TN) |
| $NH_3$ Flow | 0.0 mL/min |
| $CeO^+/Ce^+$ | <2% |
| $Ba^{++}/Ba^+$ | <2% |
| Bkgd at 220 | <2 cps |
| Pulse Stage Voltage | 1350 V |

In the case of GC-ICP-MS applications, in addition to the hardware connection, a software connection between the GC and inductively coupled plasma mass spectrophotometer using Elan Chromlink2.1® was established. The hardware and software configuration allows the inductively coupled plasma mass spectrophotometer to be triggered by gas chromatography injection and the resulting NetCDF file converted to a RAW gas chromatography file. The Raw File is then processed using traditional chromatographic software, in this case PE TotalChrom® which enables easy comparison between different runs and further processing of data with TotalChrom®.

Figure 4:
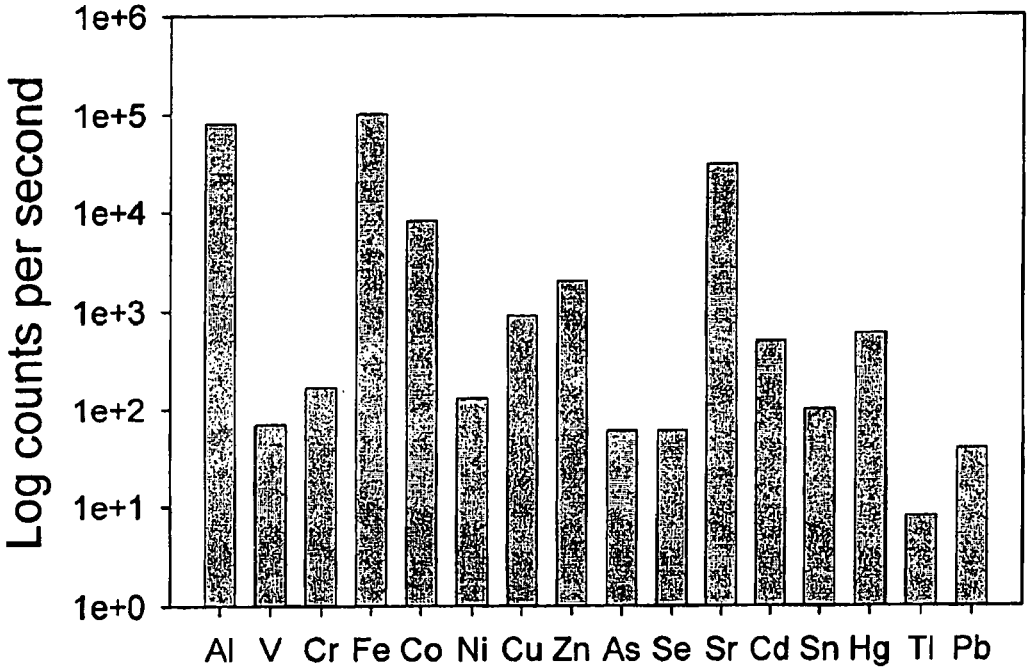
FIG. 4 is a graph of log counts per second for metals in tobacco smoke as measured by DRC-inductively coupled plasma mass spectrophotometer (methanol extract).

To identify the concentration of total metal in smoke samples, mainstream smoke was collected (five cigarettes per pad) on Whatman PVA bound glass fiber pads. The pads were placed in Teflon bombs (15 ml) to which five ml methanol were added. The pad solution was then left overnight to leach, and then shaken for six hours. The resulting extract was acidified with two ml pure nitric acid. The solution was diluted to a volume of 15 ml with ultra pure (18 meg ohm) water. The samples were analyzed by inductively coupled plasma mass spectrophotometer using a data only method. Quantification was not possible due to the absence of a matrix matched standard, lack of reliable internal standard, and the need to, in the development stage; simply qualitatively assess the relative abundance of metals in tobacco smoke. A data-only method was used and the relative abundances of metals (subtracting pad background) in tobacco smoke (counts per second) are shown in FIG. 4. Others have noted that metals of interest such as Pb, Hg, Cd, As, Zn, Cu and Sn are abundant in the smoke produced from research reference cigarettes. (V. Krivan, et al., infra at 218, W. Torjussen, et al., infra at 198). Although data only acquisition by inductively coupled plasma mass spectrophotometer provides details concerning the relative abundance of total metals in smoke these data provide no insight into the species of metals.

Organometal Standards. Stand-alone inductively coupled plasma mass spectrophotometer analysis of methanol extracts of smoke samples showed that Sn and Pb occur in abundances sufficient to allow gas chromatography separation while retaining enough signal to be detected by inductively coupled plasma mass spectrophotometer. In order to develop and test gas chromatography inductively coupled plasma mass spectrophotometer instrumental method for isolating and detecting organotin and organolead complexes in smoke, organometals standards were used to set and establish the gas chromatography inductively coupled plasma mass spectrophotometer operating conditions.

Sample-Treatment (derivatization). The gas chromatography inductively coupled plasma mass spectrophotometer method works best with those compounds whose boiling points are below the gas chromatography maximum gas chromatography column operation temperature (250° C.), enabling gaseous phase separation on the chromatography column. In the case of organic molecules such as butyl-metal complexes where the boiling point is in excess of 250° C. derivatization is required. Derivitization, the conversion of ionic polar species to their fully alkylated forms (which are normally more volatile and boiling points within the gas chromatography operational range), was used as sample pretreatment. Sample preparation for organometal speciation was simplified by ethylation in the aqueous phase, using sodium tetraethyl borate ($NaBEt_4$). In this way, derivatization into a polar, volatile species and extraction into the organic solvent can take place simultaneously. The derivatization reaction can be described as:

$$R_nM^{(4-n)+}+(4-n)NaBEt_4 \rightarrow R_nEt_{4-n}M+(4-n)BEt_3+(4-n)Na^+$$

Where R=methyl (Me) or butyl (Bu); Et=ethyl; M=Sn, Pb; n=1, 2, 3.

Lead and tin, the metals of interest, react well with $NaBEt_4$. Once a sample is derivatized, it is possible to use gas chromatography inductively coupled plasma mass spectrophotometer to study organometal speciation.

Figure 5:
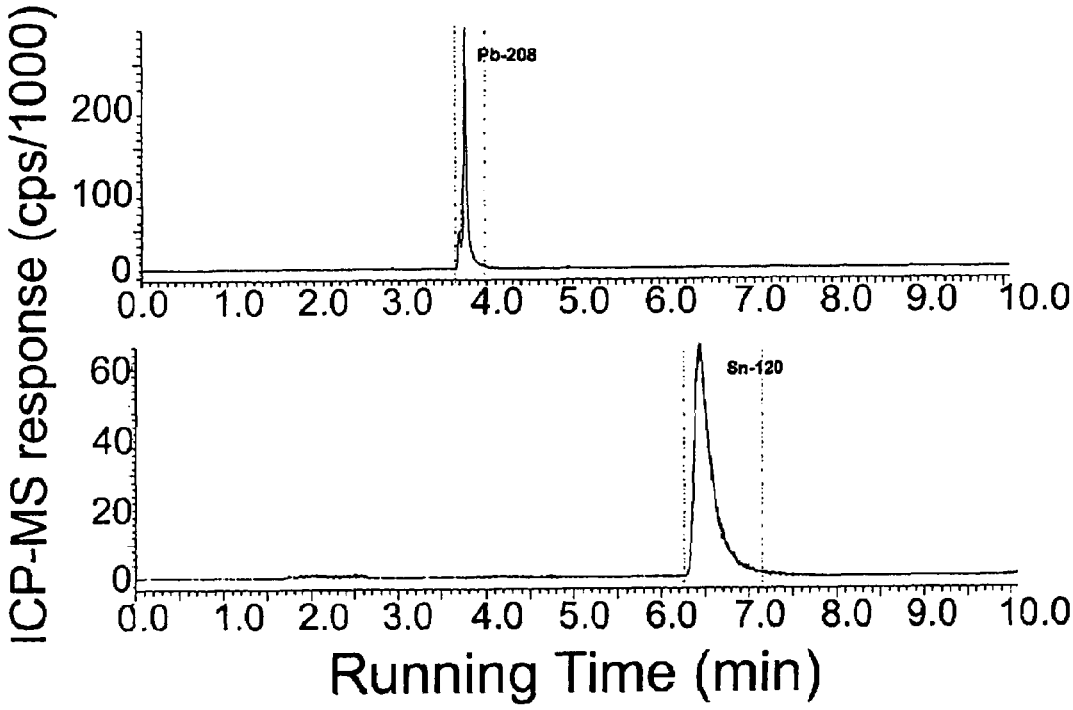
FIG. 5 is a chromatograph of mixed organolead and organotin standard solutions (derivatized with $NaBEt_4$).

As discussed above organometals standards were derivatized to ensure separation by gas chromatography and detection by inductively coupled plasma mass spectrophotometer. FIG. 5 shows the resulting chromatograms from a typical analysis of a mixed standard solution (40 ppb TBT+TML) after derivatization. A sharper peak for Pb than that for Sn was observed, suggesting that the gas chromatography column conditions (Table 1) provided for more effective separation of Me—Pb—Et (Et=ethyl) complexes over Bu—Sn—Et. When the same standard is analyzed under the same instrumentation parameters but without derivitization either of the organometal peaks was observed. The procedure and instrumentation developed can successfully derivatize and detect organolead and organotin compounds simultaneously. Also the retention times for these standards can be used as reference when analyzing smoke samples.

Organometals in Tobacco Smoke. Once the organometals have been identified successfully and the gas chromatography retention times have been established, the next step was to assess whether there were organometal species of Sn and Pb in the tobacco smoke and attempt to obtain speciation data, such as to quantify these compounds. Although there is a relatively high $^{120}$Sn background at mass 120 (~500 cps) in the absence of gas chromatography injection the organotin is resolvable from this background. We hypothesize that the high Sn background is due to the sensitivity of the DRCII instrumentation which can detect ultra-low trace levels of $^{120}$Sn in the plasma gas, Ar, or gas chromatography carrier gas, He.

Reagents and Standards. Organometal standards, Tri-N-Tutyltin Chloride (TBT) and Bromotrimethyllead (TML), were obtained from Sigma-Aldrich (Milwaukee Wis.). Stock solutions (1000 ppm as metal) were prepared by dissolving the standards in methanol. The derivatization agent, Sodium Tetraethylborate ($NaBEt_4$), was also purchased as a solid from Sigma Aldrich. 5% $NaBEt_4$ in tetrahydrofurane (THF) solution was prepared according to Schubert et. al. (P. Schubert, et al., 356 Fresenius J. Anal. Chem. 366 (2000)) The solution was prepared by dissolving 1 gm of $NaBEt_4$ in 19 gm of THF to make a 5% (w/w) solution. Once prepared the aqueous derivitization agent solution and standards were stored in glass bottles with PTEE-coated septum caps at 4° C. in the dark. All organic solvents, hexane and methanol were HPLC grade or higher purity. Reference research cigarettes, 2R4F from Kentucky Tobacco Research & Development Center were used to generate smoke. 2R4F cigarettes are not commercially available but should have similar components as the commercially available brands. Using reference research cigarettes enables comparison between studies and consistency between analytical runs. GC carrier gas (He) and inductively coupled plasma mass spectrophotometer plasma gas (liquid Ar) were both ultra pure and were obtained from NexAir (Memphis, Tenn.).

The research reference cigarettes, 2R4F, were developed in the late 1960s by the University of Kentucky Tobacco Research and Development Center. The 2R4F cigarette contains approximately 9.2 mg of tar and 0.8 mg of nicotine. The cigarettes are considered a low nicotine research cigarette. The Reference cigarettes are stored at 3.3° C. and 50–6-% relative humidity.

Five cigarettes were lit and smoked using FTC protocols (McChesney Jaeger CSM 1 machine). (National Cancer Institute, Tech. Report NIH Publication No. 96–4028 (National Institutes of Health (1996)).

The McChensey-Jaeger Single Cigarette Machine (SCM) is a computer controlled cigarette smoking machine. This machine was used for generating smoke samples. Standard FTC/ISO protocol was followed for the smoking and smoke collection. (National Cancer Institute, Tech. Report NIH Publication No 96–4028 (National Institutes of Health, (1996)). The FTC/ISO parameters are:

| | | |
|---|---|---|
| Puff Length | = | 2000 ms |
| Idle Burn | = | 58 s |

-continued

| | | |
|---|---|---|
| Max Rate | = | 1650 ml/s (equivalent to 27.5 ml/s) |
| Total Puff Cycle | = | 60 s |
| Est. Puff Volume | = | 35.01 ml/s |

Main stream smoke was collected on a Cambridge pad. The pad was leached with 5 ml gas chromatography-grade methanol. 1 ml of the resulting solution was added to a 100 ml extraction flask. Organotin and organolead standard materials were prepared. When 1 ppm mixed metal stock solution of 100 μl of the stock solution was added to 100 ml extraction flask, the final volume 52 ml. 1 ml Hexane and 100 μl $NaBEt_4$ solution (5% in THF) was added to the extraction flask. The flask was then filled to volume 50 ml with Acetate buffer (pH$^-$ 4.0). The flask was shaken at 300 rpm for approximately 20 minutes, allowing reaction and extraction to occur. Hexane layer (1 ml) was transferred to small gas chromatography vials after phase separation and was injected into the gas chromatography inductively coupled plasma mass spectrophotometer for analysis. The derivatization/extraction procedure was adapted from a method described by Schubert et al. (P. Schubert et al., 356 Fresenius J. Anal. Chem. 366 (2000)).

Figure 6:
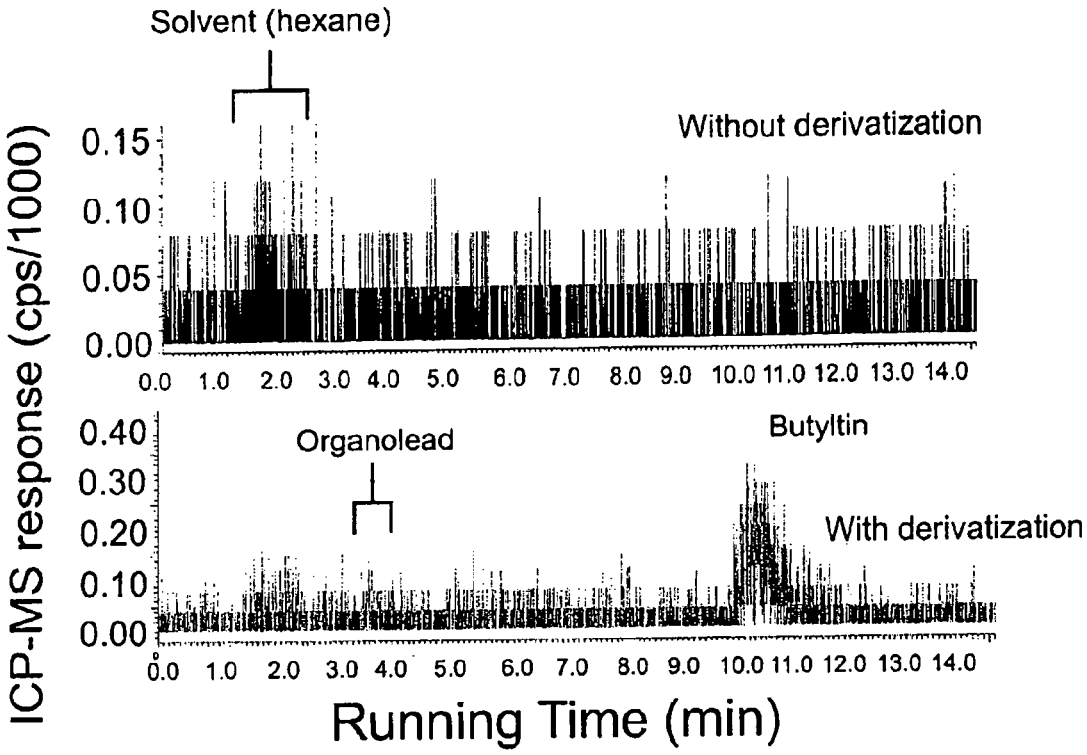
FIG. 6 is a comparison of the results of $^{208}Pb$ and $^{120}Sn$ (top nonderivatized) (bottom derivatized).

FIG. 6 shows the results from two gas chromatography inductively coupled plasma mass spectrophotometer runs of smoke samples, one with derivatization and one without. In the case of the nonderivatized smoke sample only the solvent (hexane) peaks were detected. Chromatograms of derivatized samples show that both organolead and organotin are present in the smoke samples. By comparison of the retention times and peak shapes between standard and sample chromatograms we conclude that butyltin compounds exist in tobacco smoke. There is an unknown organolead compound in the smoke and future efforts will focus on the identification of this compound.

Metal speciation of tobacco smoke was conducted using a coupled gas chromatography inductively coupled plasma mass spectrophotometer instrument. Preliminary results (both qualitative and quantitative) validate the protocol and reveal the existence of organometals in tobacco smoke. This method provides for the speciation of toxic metals in different fractions of cigarette/tobacco smoke, such as main stream smoke and side stream smoke, particulate and gas phase, as well as speciation of additional metals such as cadmium and arsenic. This method provides a way to quantify organic molecules in a complex matrix, such as, cigarette smoke.

In an alternative embodiment, the organo speciation of surface water in rivers was analyzed. DRC-ICP-MS: Two separate 1 L water samples were collected from each study site, and filtered (0.45 um) and analyzed immediately upon return to the laboratory. Water used for total metal concentration (DRC-ICP-MS) was acidified and stored in a 4° C. refrigerator, before analysis. GC-ICP-MS: Despite the multi-element analytical capabilities of DRC ICP-MS, all analytes have to be separable by GC in order to be individually detected by the mass spectrometer. Those organometallic compounds with higher boiling points (higher than the maximum GC column operation temperature) will not be separated and detected by the GC-ICP-MS system. Derivatization, the conversion of ionic polar species into their fully alkylated forms, was utilized as a mean of sample pretreatment. We present here in situ derivatization with sodium tetraethylborate ($NaBEt_4$). 1 mL of the water sample was added to a 25 mL extraction flask. Organotin standard materials were used to prepare 1 ppm mixed metal stock solution. 100 uL of the stock solution was added to 100 ml extraction flask. Organotin standards were used to compare retention times of organo-Su peaks in samples from study sites. 2 mL Hexame and 100 μL $NaBEt_4$ solution (5% in THF) was added to the extraction flask. The flask was then filled to mark with Acetate buffer (pH–4.0). The flask was shaken vigorously for ten minutes, allowing reaction and extraction to occur. After phase separation the Hexame layer (on the top) was passed through sodium sulfate, and then transferred to small vial and was subjected to GC-ICP-MS analysis. A Clarus 500 GC and a DRC II ICP-MS (both PerkinElmer) were connected with transfer line 30. The transfer line 30 is heated to a temperature comparable to the temperature of gas chromatography effluent of the chromatograph column. [How?] High flow rate of ultra pure argon gas was applied at the end of the transfer line and heated, right before the gas stream entering the sampling introduction system of the ICP-MS. In addition to the hardware connection, a software connection between GC and ICP-MS with Elan Chromlink2.1® as previously described. The ICP-MS can be triggered from GC injection and the resulted NetCDF file from Elan can be converted to RAW file of GC, which enables easy comparison between different runs and further processing of data with Total-Chrom®.

Figure 7:
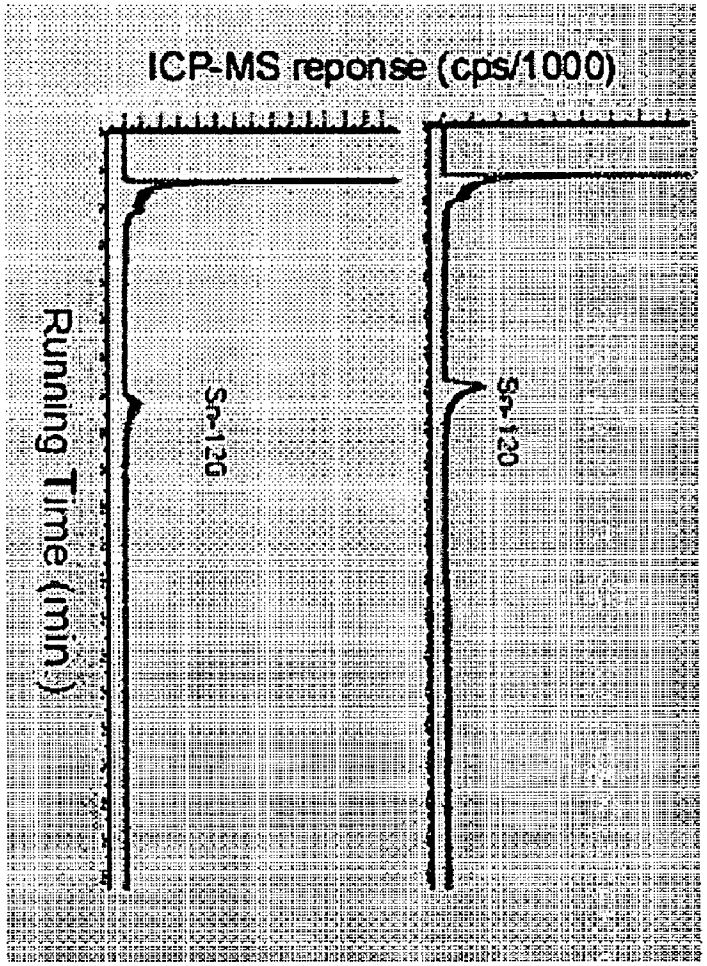
FIG. 7 shows a chromatogram of a triethyl tin standard.
Figure 8:
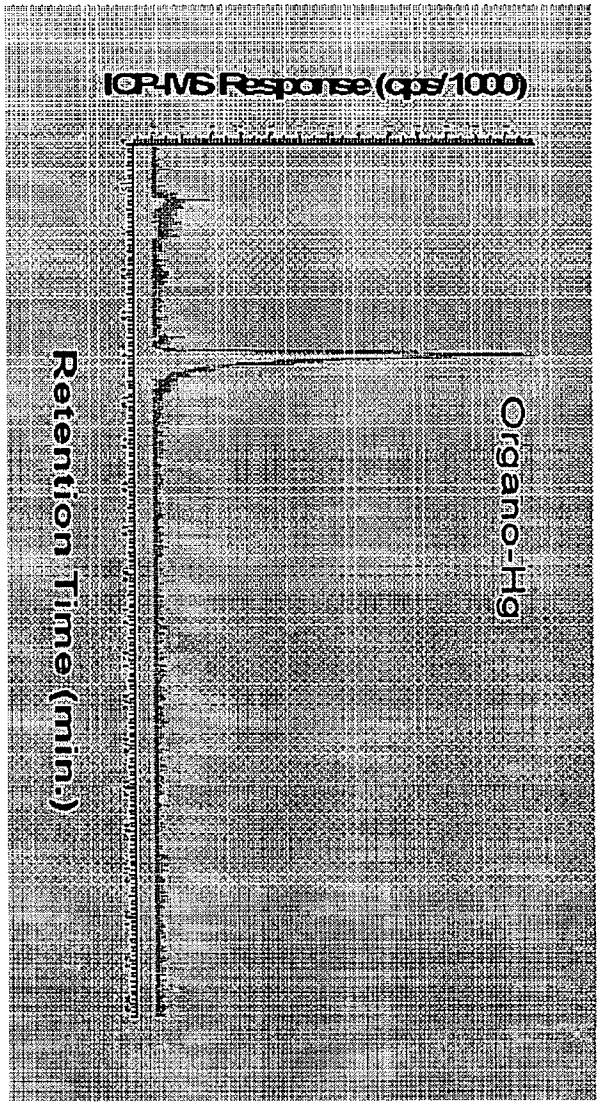
FIG. 8 shows a GC-ICP-MS chromatogram

FIG. 7 shows a chromatogram of an Triethyl Tin standard (top), and one of the study samples (bottom) only looking at the Sn-120 content of our samples, both of which have been derivitized with $NaBEt_4$. By comparing the chromatogram of the standard Tin to the chromatogram of the study sample, Triethyl Tin is present at our study sites. In FIG. 8, a GC-ICP-MS chromatogram of organomercury detected from derivatized water samples shows that this particular mercury species occurs in the dissolved phase.

Although the foregoing invention has been described in some detail by way of illustration and example for purposes of clarity of understanding, it will be obvious that certain changes and modifications may be practiced within the scope of the appended claims.

We claim:

1. A transfer apparatus for transmitting a gas phase sample containing an analyte to be measured from a gas chromatograph to a inductively coupled plasma mass spectrometer comprising:

a transfer line connected to said gas chromatogaph, said transfer line comprising means to transmit said gas phase sample to a pre-heater;

a means to introduce gas phase sample to said transfer line from the sample source;

a pre-heater connected to said transfer line configured to heat said gas phase sample to a temperature to facilitate detection of an analyte; and a connector configured to attach said heated gas phase sample with a inductively coupled plasma mass spectrometer.

2. The apparatus of claim 1 wherein said pre-heater further includes means to provide heated make-up gas to said gas phase sample.

3. The transfer apparatus of claim 1 wherein said means to transmit said gas phase sample is a capillary tube.

4. The transfer apparatus of claim 1 further comprising means to adjust pre-heater temperature.

5. The transfer apparatus of claim 1 wherein said means to introduce sample is selected from the group consisting of: thermogravimetric analysis, head space sampling and direct atmospheric sampling.

* * * * *